United States Patent [19]

Wiederkehr

[11] Patent Number: 4,718,337

[45] Date of Patent: Jan. 12, 1988

[54] APPARATUS FOR THE TREATMENT OF PLANT MATERIAL

[75] Inventor: Hans Wiederkehr, Rümlang, Switzerland

[73] Assignee: Pharos Inventions Ag, Zug, Switzerland

[21] Appl. No.: 750,393

[22] Filed: Jun. 28, 1985

[30] Foreign Application Priority Data

Jul. 4, 1984 [CH] Switzerland ..... 3233/84

[51] Int. Cl.[4] ..... B30B 9/16

[52] U.S. Cl. ..... 100/75; 100/37; 100/146; 100/148; 100/117; 100/193

[58] Field of Search ..... 100/37, 73, 74, 75, 100/145–150, 193

[56] References Cited

U.S. PATENT DOCUMENTS

| | | | |
|---|---|---|---|
| 2,098,110 | 11/1937 | Schertz | 100/37 X |
| 3,035,304 | 5/1962 | Reifenhauser | 100/145 X |
| 3,460,466 | 8/1969 | Ginaven | 100/117 |
| 3,939,763 | 2/1976 | Sato | 100/117 X |
| 4,323,007 | 4/1982 | Hunt | 100/37 |

FOREIGN PATENT DOCUMENTS

| | | | |
|---|---|---|---|
| 1275477 | 10/1961 | France | 100/117 |
| 186644 | 1/1958 | Sweden | 100/117 |
| 310680 | 5/1929 | United Kingdom | 100/145 |

*Primary Examiner*—Peter Feldman

*Attorney, Agent, or Firm*—Bachman & LaPointe

[57] ABSTRACT

The apparatus comprises a plurality of stages having screw presses, the material passing out from the outlet side of the stages being passed by a transfer duct to the inlet side of the following stage. Each stage has a speed adjustable independently of the speed of the other stages. Compared with known screw presses, the advantage exists that following each treatment in a stage, by means of an opening in the transfer duct, the material can be measured, checked or subjected to an additional treatment. The number of stages can also be adapted to the material being processed and there is also a relatively large freedom with regards to the arrangement of the apparatus.

8 Claims, 3 Drawing Figures

APPARATUS FOR THE TREATMENT OF PLANT MATERIAL

BACKGROUND OF THE INVENTION

The present invention relates to a process for the treatment of plant or vegetable material, pretreatment by pressing leading to the obtaining of a liquid phase and a solid phase from the plant material, said phase being further processed separately, as well as to an apparatus for performing this process.

It is known to work up plant material in such a way that the minimum quantity of nutrients contained therein is lost. In view of the careful treatment required, thermal or chemical processes are unusable, so that it is merely possible to employ a mechanical process, in which the breaking down of the cells takes place by pressing, linked with a crushing, scraping or abrading treatment. If a time between the harvest of the material or crop and its processing is short, this process can be considered to constitute an optimum, because it is also possible to prevent mold formation through a germicidal treatment. Further processing of the liquid phase makes it possible to extract the protein contained therein, which can be used in many different ways for feeding humans and animals. The remaining liquid residue is removed from the solid phase and is simultaneously preserved. As the thus obtained product still has a high protein content, it is best used as an albumin carrier in animal food.

In a known process (EP 108 762), the solid and liquid phases are obtained by a pressing treatment of the plant material. In particular, the use of screw presses is proposed, because in order to protect the nutrients contained in the plant material, it is only possible to use a mechanical preparation and not a thermal or chemical preparation. The purpose of this preparation is to open or destroy the protective coatings of the plant cells by an intense crushing, scraping and abrading treatment of the plant material, so that a liquid phase consisting of cell sap and a solid phase essentially consisting of plant fibers are obtained. This process can be used for processing plant materials of different origins, but the separation process, as it essentially consists of a single pressing treatment and consequently takes place in a single pressing means, cannot be adjusted in an optimum manner to the different plant crops.

A known pressing means (EP 108 763) is constructed as a twin-screw press or extruder comprising a plurality of casing elements simultaneously defining treatment sections, in which the plant material is successively treated until at the outlet side the solid phase is discharged as a dry substance, usually in pellet form. The resulting liquid phase is pumped out or is sucked off after being converted into a vaporous phase. Thus, such a press brings about the separation of the two aforementioned phases. Through the arrangement of the screw press in successive, lined up sections, the corresponding screw section can admittedly be adapted to the change of the product being pressed, but this adaptation is not of an optimum nature, because on the one hand the speed is the same for all the processing sections and on the other it is substantially impossible to carry out a check and then control the material being pressed due to the directly succeeding treatment sections.

SUMMARY OF THE INVENTION

The present invention also relates to the field of treating plant or vegetable materials for te separation of the two phases, particularly with a view to extracting protein and an also protein-containing solid product and only relates to part of this treatment, i.e. the preparation of the plant material for separating into the liquid and solid phases. Within this scope, the problem of the invention is to so further develop the aforementioned process, that the treatment is adapted to the particular crop to be processed and consequently an optimum and simultaneously careful treatment of the crop is obtained.

According to the invention this problem is solved in that the product being pressed undergoes two or more separate and independent treatment stages successively in individual, closed pressing zones, which are arranged in series and are interconnected by connecting zones. Thus, the treatment conditions in the individual pressing zones can be set independently of one another. Appropriately checks and measurements can be performed on the product passing out of the pressing zone in the aforementioned connecting zones, the product being additionally treated, if this is considered to be necessary.

The invention also relates to an apparatus enabling the inventive process to be performed in an optimum manner. This problem is solved in that at least two or three screw presses are arranged in a multistage unit and, with the exception of the last screw press, the material outlet is connected to the material inlet of the following screw pressed by a transfer duct, which contains a conveyor for conveying the material leaving the pressing material outlet into the following pressing material inlet.

BRIEF DESCRIPTION OF THE DRAWINGS

The invention is described in greater detail hereinafter relative to non-limitative embodiments and the following drawings, wherein show.

DETAILED DESCRIPTION OF THE PREFERRED EMBODIMENTS

Figure 1:
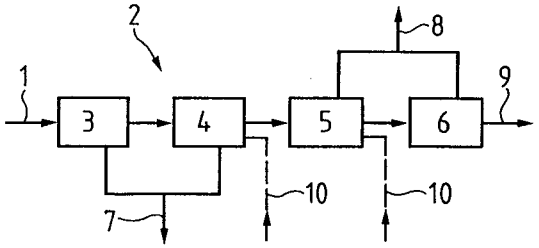
FIG. 1 is a block diagram of an apparatus for obtaining a liquid and solid phase by the treatment of plant material.

According to FIG. 1 plant material 1, which has appropriately just been harvested, is fed into a multistage unit 2 which, according to FIG. 1, has four stages 3, 4, 5 and 6. However, as a function of the plant or vegetable material to be processed, the multistage unit 2 can comprise two, three or more than four stages. The same number of stages are used as are required for a completely satisfactory separation of the plant material 1 into a liquid phase and into a solid phase. Stages 3–6 are independent pressing zones, in which the plant material 1 is worked up. This working up process essentially consists of a pressing operation, which can be linked with crushing, scraping or abrading of the material. This operation leads to the breaking down into cell sap and a fiber-rich solid phase. This separating operation more particularly takes place in the first and second stages 3, 4, so that in connection therewith a cell sap drain 7 is shown. The cell sap drain has been omitted in connection with the two following stages 5, 6, because the residual moisture has largely evaporated therein as a result of the heat caused by the preparation and is removed by corresponding lines from stages 5, 6 in the form of vapor 8. The pressing material passes out of the final stage 6 as a dry substance 9. It is a preserved solid product, which still has a high protein content and is suitable for animal feed. The solid product can be made available in different forms, e.g. as pellets.

Broken lines in FIG. 1 in connection with stages 4 and 5 illustrate the insertion of media 10 of different types, e.g. the supply of air, vapor, steam, heat or liquid. The arrangement in the form of independent stages make it possible to carry out an additional treatment of material between each stage. The possibilities represented in FIG. 1 can also be varied. Further stages can be provided with a cell sap drain, while the steam or vapor drain can also be extended to further stages, as can the supply of media 10. The multistage unit makes it possible to achieve a very extensive adaptation for an optimum preparation of the particular plant material 1.

FIG. 1 does not show the pretreatment of the plant material 1 introduced into the first stage and the further processing of cell sap 7, because this is not essential for the purposes of the present invention. This pretreatment consists of washing, drying, sorting of foreign bodies and comminuting the plant material 1. The further treatment of the cell sap 7 comprises the pasteurization of the protein and the separation thereof from the residual fluid.

Figure 2:
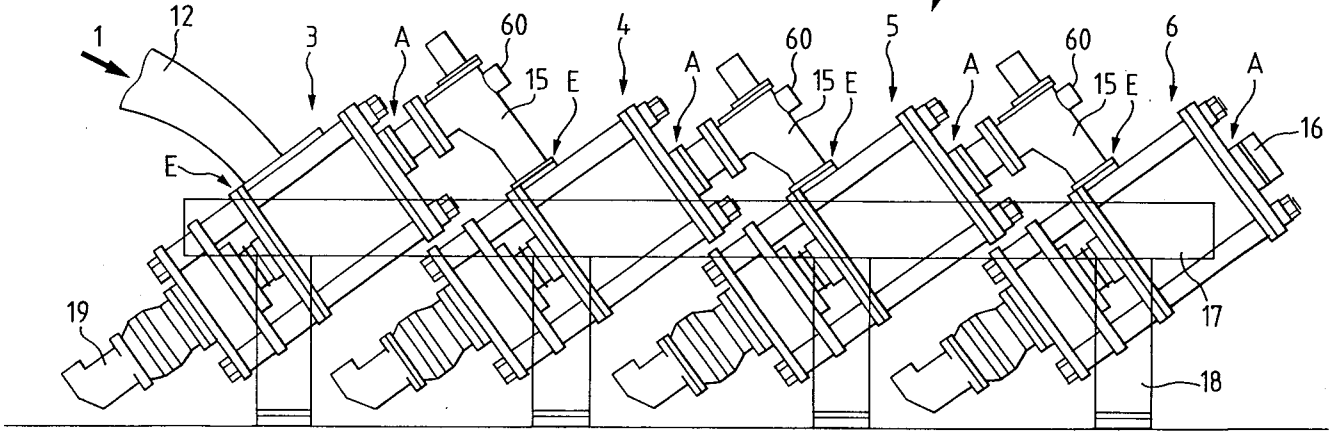
FIG. 2 is a diagrammatic view of a multistage unit of the apparatus of FIG. 1.

The multistage unit 2 shown in FIG. 2 comprises four stages 3–6, whose pressing zones are constructed as screw presses, e.g. with variable pitch screws, for the synchronous or non-synchronous operation of said screws. Fundamentally the separation of the liquid and solid phases could be carried out by using other means, but present experience has shown that the screw press is particularly suitable. Thus, although the apparatus for the treatment of the plant material is described relative to the use of screw presses, it is not restricted thereto.

According to FIG. 2, the individual stages 3–6 with their screw presses are arranged in a sloping position, the vegetable or plant material 1, optionally following its pretreatment, being introduced through a line 12 to the inlet side E of the screw press of the first stage 3. On outlet side A, the discharged material is passed through a transfer duct 15 to the inlet side of the following stage 4. Each of the stages 3, 4, 5 is connected by such a transfer duct 15 to the inlet side E of the following stage. It is only on the outlet side A of stage 6 that a pressing plate 16 is provided, which brings the dried and preserved solid product into the desired form.

The four stages 3–6 are fixed in a frame, which is formed by two, diagrammatically represented longitudinal beams 17, which are supported on supports 18. The screw press of each stage is driven by a hydraulic drive, whereof the hydraulic motor 19 is shown in FIG. 2. It is essential that each hydraulic motor 19 is part of an independent hydraulic gear, so that the speed of each screw press can be individually adjusted and set. Electrical or mechanical variable-speed drives could be used instead of hydraulic drives.

Figure 3:
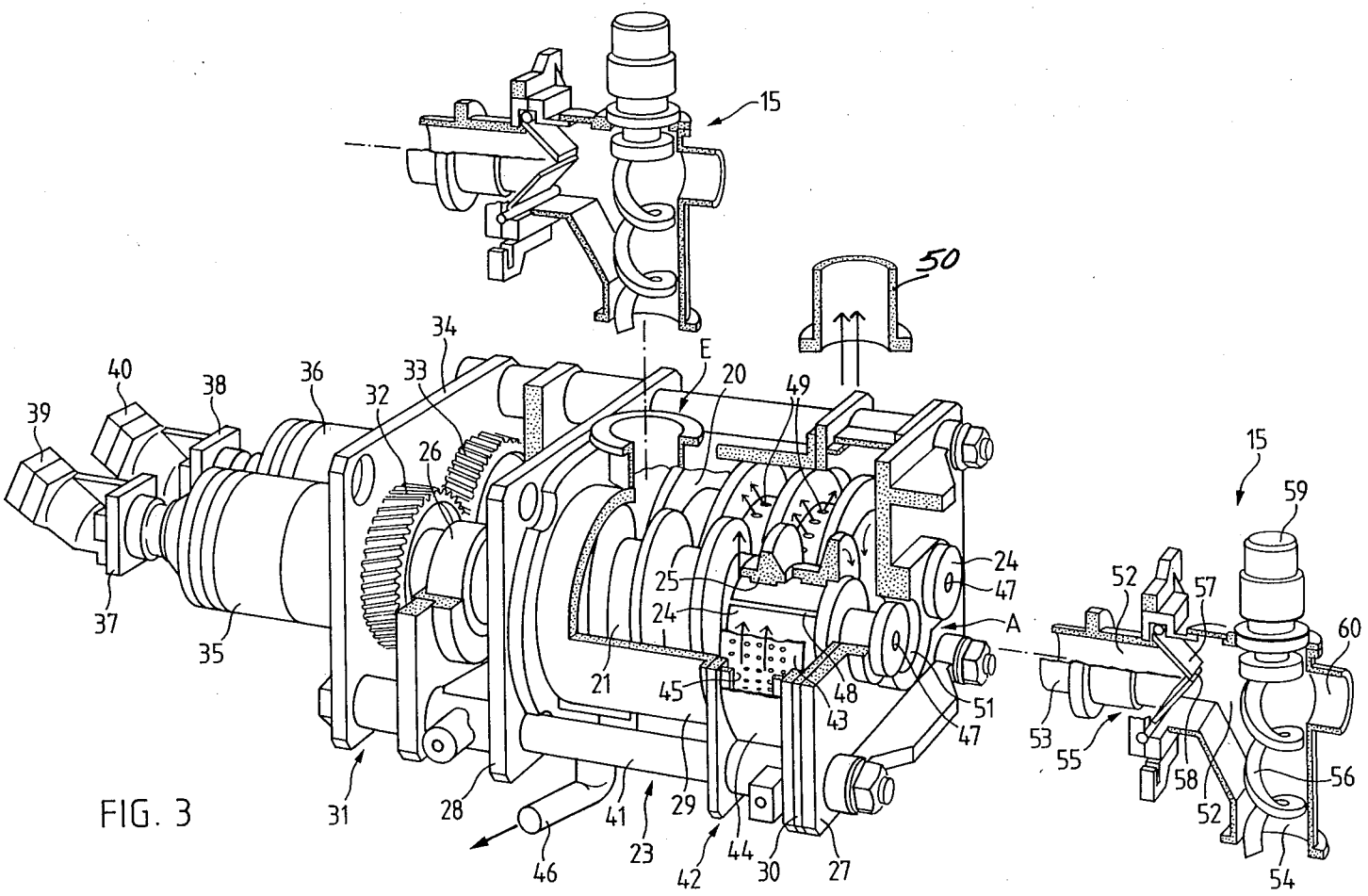
FIG. 3 is a diagrammatic, three-dimensional view of a screw press as part of a multistage unit according to FIG. 2 with in each case one transfer duct, shown in broken away form, at the material inlet and at the material outlet.

FIG. 3 shows one of the stages 3–6 in the form of screw presses with partly broken-away casing and with in each case one transfer duct 15 on the inlet side E and on the outlet side A. For the first stage 3, the inlet-side transfer duct 15 is replaced by the line 12 for introducing the pretreated plant material and for the final stage 6, the outlet-side transfer duct 15 is replaced by pressing plate 16. However, in most parts the construction of stages 3–6 is similar. The screw press comprises two screws 20, 21 and a screw casing. Each screw 20, 21 has a screw shaft 24, on which the screw segments 25 are lined up and secured. The use of individual screw segments 25 makes it possible to assemble screws having different pitch characteristics and replace individual segments without having to replace the entire screw. Screw shafts 24 are on either side mounted in the wall of screw casing 23, e.g. by means of sliding or roller bearings 26.

Screw casing 23 has two terminal flanges 27, 28 with an interposed hollow cylindrical casing member 29, the outlet-side terminal flange 27 being covered by a wear-resistant pressing plate 30.

A bearing and gearbox 31 containing the bearings 26 and the gear pair 32, 33 is arranged at the inlet-side of terminal flange 28. The bearing and gearbox 31 is closed by an external flange 34, to which are fixed two clutch housings 35, 36, which have a flange 37, 38, to which is in each case fixed a hydraulic motor 39, 40. The shafts of hydraulic motors 39, 40 are connected by clutches housed in the clutch housing 35, 36 to the screw shafts 24, which extend through the screw casing 23 and the bearing and gearbox 31.

Hydraulic motors 39, 40 form part of a hydraulic variable-speed gear, whose variable delivery pump supplies the oil stream for the appropriately parallel connected hydraulic motors 39, 40. As the shafts of the hydraulic motors 39, 40 are coupled by the gear pair 32, 33, each of said hydraulic motors supplies half of the drive power required for the screw press. The power requirement of the individual stages varies, the first stage 3 generally requiring less power, so that in this case one of the hydraulic motors 39, 40 can be omitted. Power branching then takes place in gear pair 32, 33. The screw casing 23 and the bearing and gearbox 31 are held together by pump bolts and consequently form a closed casing.

The cell sap is mainly obtained in the first stages, i.e. in first and second stages 3 and 4. Therefore part of the casing 23 is replaced by an intermediate casing 42, which as the casing wall has a cylinder cover 43, which is surrounded by a ring main 45 terminated by a wall 44. The cell sap passing out of the cells of the plant material collects over the shortest path in ring main 45 and is supplied by a drain 46 to the further processing means.

Arrows within the screw casing 23 illustrate the passage of a medium, e.g. air or steam, which is introduced through bores 47 into the screw shafts 24 and passes out via ducts 48 and radial bores 49 between or in the screw segments 25 into the closed screw casing 23. In the crest of screw casing 23 is provided a not shown connecting piece, to which is connected a line 50, which draws off air and cell sap. The connecting piece for line 50 is located in the crest region at the outlet-side and of the screw press. At the outlet side, the pressing material passes through an outlet into the transfer duct 15.

The outlet-side transfer duct 15 has a substantially angular channel 52, in whose inlet-side pipe member is provided a baffle means 55 and in whose outlet-side pipe member 54 is provided a conveyor 56 for conveying the material. The baffle means 55 has two swivellable baffle flaps 57, which are held in a given swivel position by a swivel drive (not shown), e.g. a hydraulic cylinder. A variable passage gap 58 can be set by the baffle flaps 57 and as a result the pressing pressure in the screw press can be regulated. Conveyor 56, e.g. a screw conveyor, is driven by a motor drive 59, e.g. a hydraulic motor. The arrangement of the baffle means 55 in transfer duct 15 provides the advantage that the action thereof can be controlled, e.g. by measuring the temperature of the material being pressed. Thus, an opening 60 for monitoring the material can be provided in channel 52. Said opening 50 can also be used for the introduction of media, e.g. air, steam or liquids.

The inlet-side transfer duct 15 shown in FIG. 3 is identically constructed to the outlet-side transfer duct, so that it will not be described. The transfer ducts 15 as stated, are used for checking and introducing media, as well as for ensuring a continuous flow of the material through the apparatus. For this purpose, the speed of the motor drives of conveyors 56 can be regulated.

An appropriate arrangement of the screw presses in a series arrangement of the individual stages 3–6 is shown in FIG. 2, but some other arrangement is also possible. In any case, this arrangement is space-saving and can be adapted to the available space. This is an important requirement, so that the complete apparatus, including the pretreatment and subsequent treatment parts can be installed on the platform of a vehicle. It is appropriate to install the apparatus on a platform by means of which it can be placed on a vehicle.

Since in the final pressing stages, i.e. in the third and fourth stages 5, 6, the material only contains a little moisture and also has a relatively high temperature of e.g. 60°–80° C., this moisture passes out in the form of steam or vapor and is sucked off through lne 50. There is no need for intermediate casing 42 and casing 29 then extends up to pressing plate 30. This means makes it possible to keep a single pressing stage under vacuum.

In place of plant material, it is also possible to process in the described apparatus garbage, sewage sludge, wood waste, e.g. bark, sawdust, etc., straw and peat. However, it is also possible to produce granular material from motor vehicle tire fragments, e.g. for use as fertilizers, or from glass fragments with particle sizes below 1 mm. As a result of its construction in the form of separate stages, the apparatus is adaptable, i.e. with regard speed, rotation direction, pitch and shape of the screws and with regards the treatment of the material with heat, coal, steam, liquids and gases, so that it is possible to treat the most varied materials, as has been stated hereinbefore.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for treatment of plant material enabling a liquid and solid phase to be obtained therefrom which comprises: a multistage unit having at least two screw presses each having an individual drive wherein the speed of each drive is independently adjustable, said presses separately arranged in stages including a final stage; a material outlet from each of said stages and a material inlet into each of said stages; a transfer duct connecting each of said outlets except the outlet from the final stage with the next succeeding inlet including a conveyor for conveying the material passing out of said outlet into the following material inlet, wherein said plant material is successively subjected to pressing, said transfer duct being provided with an adjustable baffle means for material passing out of said outlet, said conveyor means is a screw conveyor, and said following material inlet includes an inlet-side pipe member housing said screw conveyor.

2. An apparatus according to claim 1, wherein the screw presses are successively arranged with a screw axis sloping with respect to the horizontal, the transfer duct being constructed as an angular channel between two screw presses.

3. An apparatus according to claim 1, wherein the screw presses are equipped with regulateable and/or reversible drives, the speed of each screw press being adjustable independently of the speed of the remaining screw presses.

4. An apparatus according to claim 1, wherein the speed of the conveyor in the inlet-side pipe member is adjustable.

5. An apparatus according to claim 1, wherein the screw presses are twin-shaft presses, whose hollow screw shafts are mounted at both ends in a screw casing, screws assembled from screw segments being fixed on the screw shafts.

6. An apparatus according to claim 1, including a screw casing which has a casing member, whose outlet-side end is constructed in smooth-walled form or as a cylinder cover, the latter being provided with a ring main having at least one drain.

7. An apparatus according to claim 5, wherein in the screw shafts and screw segments are provided channels and bores, to whose outlet side can be supplied a medium, e.g. heat, steam or liquid.

8. An apparatus according to claim 6, wherein said casing member has a crest area and wherein an opening with a line is provided in the crest area on the outlet-side end of the casing member.

* * * * *